US006581769B2

(12) United States Patent
Nist

(10) Patent No.: US 6,581,769 B2
(45) Date of Patent: Jun. 24, 2003

(54) CORRUGATED SHIPPING CONTAINER WITH SELF-HINGED DOOR

(76) Inventor: Robert Nist, 23400 - 71st Pl. South, Kent, WA (US) 98032

( * ) Notice: Subject to any disclaimer, the term of this patent is extended or adjusted under 35 U.S.C. 154(b) by 6 days.

(21) Appl. No.: 10/007,071

(22) Filed: Dec. 4, 2001

(65) Prior Publication Data

US 2002/0084202 A1 Jul. 4, 2002

Related U.S. Application Data

(60) Provisional application No. 60/251,306, filed on Dec. 4, 2000.

(51) Int. Cl.[7] ..... B65D 19/00

(52) U.S. Cl. ..... 206/386; 206/386; 206/599; 206/600; 52/173.1; 52/726.1; 52/726.2; 52/719; 108/51.11; 108/51.3; 108/55.1; 108/56.1; 108/56.3; 220/1.5; 229/122; 229/198.2; 229/920

(58) Field of Search ..... 206/386, 599, 206/600; 52/173.1, 726.1, 726.2, 719; 108/51.11, 51.3, 55.1, 56.1, 56.3; 220/1.5; 229/122, 198.2, 920

(56) References Cited

U.S. PATENT DOCUMENTS

| | | | | | |
|---|---|---|---|---|---|
| 2,054,764 | A | * | 9/1936 | Berkowitz | 229/122 |
| 2,083,114 | A | * | 6/1937 | Blechman | 229/122 |
| 2,887,241 | A | * | 5/1959 | MacKenzie | 229/122.21 |
| 5,069,338 | A | * | 12/1991 | Grigsby | 206/386 |
| 5,794,542 | A | | 8/1998 | Besaw | |
| 5,881,652 | A | | 3/1999 | Besaw | |
| 6,041,718 | A | | 3/2000 | Brandes et al. | |
| 6,135,030 | A | | 10/2000 | Besaw | |
| 6,216,899 | B1 | * | 4/2001 | Vicari | 206/600 |
| 6,298,994 | B1 | | 10/2001 | Debrunner et al. | |

* cited by examiner

*Primary Examiner*—Luan K. Bui
(74) *Attorney, Agent, or Firm*—David L. Garrison; Garrison & Assoc. PS

(57) ABSTRACT

A corrugated collapsible shipping container is disclosed which includes a rigid pallet having side panels, a back panel and a front door panel extending upwardly from the pallet, one side panel and the back panel formed from a sheet of corrugated material, and the other side panel and the door panel formed from a second sheet of corrugated material. Corrugated support beams extend across the top with a top sheet closing the container. The front door is self-hinged for access into the container.

14 Claims, 5 Drawing Sheets

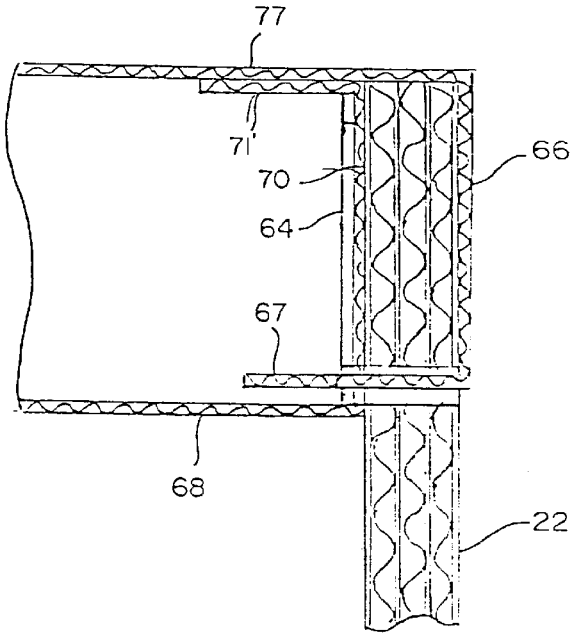
FIG. 8
FIG. 9
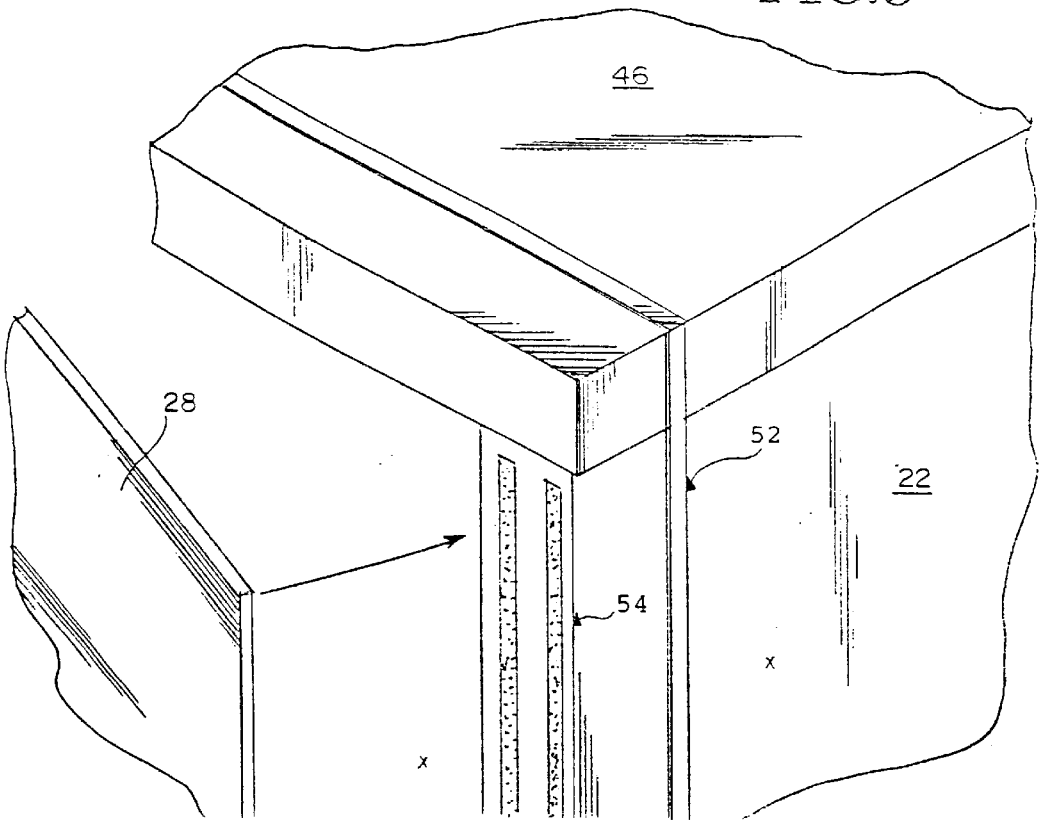

CORRUGATED SHIPPING CONTAINER WITH SELF-HINGED DOOR

CROSS-REFERENCE TO RELATED APPLICATIONS

This application claims the benefit of U.S. Provisional Application Serial No. 60/251,306, entitled Corrugated Shipping Container With Self-Hinged Door, filed Dec. 4, 2000.

FIELD OF INVENTION

This invention relates to a lightweight, high strength, disposable or recyclable, corrugated material, easily assembled, shipping container that is resistant to degradation from moisture. The shipping container of this invention has at least one self-hinged door for access in the erected state, and integrated support beams capable of providing support and maintaining position without the use of fasteners or adhesives.

BACKGROUND OF THE INVENTION

The shipping and storage of goods and materials forms a tremendous industry, which has a major role in the national economy. A large quantity of the goods and materials shipped each year are packed in some type of shipping container. These shipping containers generally take the form of large boxes comprising of a base, side panels, and a top. The containers are usually placed on pallets for support and to allow the use of forklifts for moving them around or loading them on trucks.

Users of traditional shipping containers are faced with several problems. These containers and pallets are generally constructed of heavy materials to ensure that they are durable. Containers made to be durable are expensive to make and use due to the cost of the materials, cost of construction, and cost of disposal. Usually these conventional types of containers and pallets have to be returned after the shipment to the shipper for reuse or disposed of in a proper manner. A disadvantage to conventional type containers is that when they are empty they are relatively bulky and expensive to transport to the locations where they are needed. Many designs have been proposed which allow such containers to be collapsed for easy transport when empty. However, most existing designs for collapsible containers are frequently complicated to assemble, difficult to manufacture, made from relatively expensive and complicated components, and/or made primarily from non-renewable materials.

Another problem common with most box shaped shipping containers is that once the container is assembled, it must be loaded or unloaded from the top. A person packing the container can overcome this problem by leaving a sidewall off of the container until it is loaded, but this solution creates the potential problem of improper assembly if the container is overloaded, or the sidewall is put on improperly. In either case, once the container is assembled and packed, it is difficult, if not impossible, to access its contents without partial or even total disassembly of the container.

Recently, containers made entirely of corrugated material have been proposed as solutions to the problems noted above. Examples of these containers can be seen in U.S. Pat. Nos. 5,794,524 and 6,041,718, issued to Larry G. Besaw and Michael G. Brandes respectively. The containers disclosed in both of these patents provide a lightweight alternative to the traditional box and pallet structure. The container disclosed in the '718 patent also addresses the problem of accessing the contents by providing a removable sidewall. However, shipping containers often encounter moist environments and containers constructed of corrugated material that are left sitting for an extended period of time can begin to degrade around the bottom of the container. Neither of the containers above addresses the potential of moisture damage in that they do not have adequate moisture resistance at the bottom margin thereof. Additionally, by addressing the access problem with a removable sidewall, the '718 patent removes any structural support provided by a permanent sidewall with its edges securely connected at the corners of the container.

Both of the patents above also disclose the use of corrugated material to support the top of the container packs. The supports disclosed in these patents are attached to the container pack using adhesives or other fastening devices. Neither of these patents teaches a method of holding the supports in place without the use of some type of external fastening device or adhesive.

SUMMARY

Accordingly, it is an object of this invention to provide a lightweight, high strength, disposable or recyclable shipping container.

It is a further object of this invention to provide such a container that allows access to the contents of the container without adversely effecting the structural support of the container.

It is yet another object of this invention to provide such a shipping container that is not as susceptible to moisture damage as some corrugated containers that are currently available.

Another object of this invention is to provide such a shipping container at a relatively low price.

These and such other objects of the invention, as will become evident from the disclosure below, are met by the invention disclosed herein.

This invention provides a lightweight, high strength, disposable or recyclable collapsible shipping container having a top panel and walls made of corrugated material that are mounted on and attached to a pallet. The invention also provides interlocking corrugated support beams to structurally support the shipping container. This invention further provides a door self-hinged at one corner and extending upwardly from the pallet.

A preferred embodiment of the shipping container of this invention includes a pallet, one sheet of corrugated material for the top panel, two additional sheets of corrugated material for the side panels, rear panel and door, at least two vertical uprights, and three support beams made of corrugated material. Each of the sheets of corrugated material, used for walls and doors, provides is large enough to provide one side panel and one rear panel or door for the container, and to provide an overlapping margin on the end opposite the door.

To assemble the shipping container, the sheets of corrugated material that are used for the side panels are placed on a lip located on the sides and ends of the pallet and the corrugated material is attached to the pallet on the sides using fasteners (preferably screws). The vertical uprights are placed adjacent to the side panels in the corners of the container that are opposite from the self-hinge on the sheet of corrugated material. If only one door is desired, the rear panel opposite the door is then attached to the pallet with fasteners (preferably screws), the overlapping margin of the other sheet of corrugated material is then folded inward and the margin and rear panel are attached to the vertical support with fasteners (preferably screws).

The support beams are then assembled by folding a seamed sheet of corrugated material into a square conduit, closing the end flaps and locking the ends with a locking tab. The top panel flap is folded over the outside of the walls of the shipping container and the beam interconnection tab is placed through slots in the walls and into the beam tab slot, thereby locking the support beams in place. The container can then be loaded from the top or the door end. After the container is loaded, the top panel is placed on the container, the container is covered with a waterproof bag, and the bag is secured with straps placed around the container.

According to the teachings of this invention, the corrugated material is positioned above the bottom of the pallet so that moisture from the support surface does not enter and degrade the container. The self-hinged door is a part of a sheet of corrugated material forming the door and one side panel. The other side panel and the rear panel are formed from a second sheet of corrugated material. Support beams constructed of corrugated material extend between the tops of the side panels and a sheet of corrugated material covers the top. The container is easily assembled, and the self-hinged door provides easy access to the interior of the container. The container disclosed in this invention is equally suitable for use in shipping and storing commercial or household goods.

For example, the moving and storage of furniture and household articles form a tremendous industry as there are a large number of families and individuals moving from place to place each year. Timing differences between selling an existing home and purchasing or building a new home may require the short-term storage of household goods and furnishings. In such cases, the container disclosed in this invention can be used to move the household goods and then used as a temporary in situ storage space that provides ready access to items that a person may need before moving into his or her new home. Such readily available, easily accessible, storage is also suited for people who require temporary storage of household or workplace goods and furnishings due to home or workplace remodeling.

BRIEF DESCRIPTION OF THE DRAWINGS

FIG. 8 is a cross sectional view taken along line 8—8 of FIG. 7 showing the attachment of the beam to the sidewall in greater detail.

FIG. 9 is a perspective view of the corner of the container upon which the self-hinged door abuts, showing adhesive closure fasteners used to hold the door in the closed position until shipping bands are placed around the container.

BEST MODE OF CARRYING OUT THE INVENTION

Figure 1:
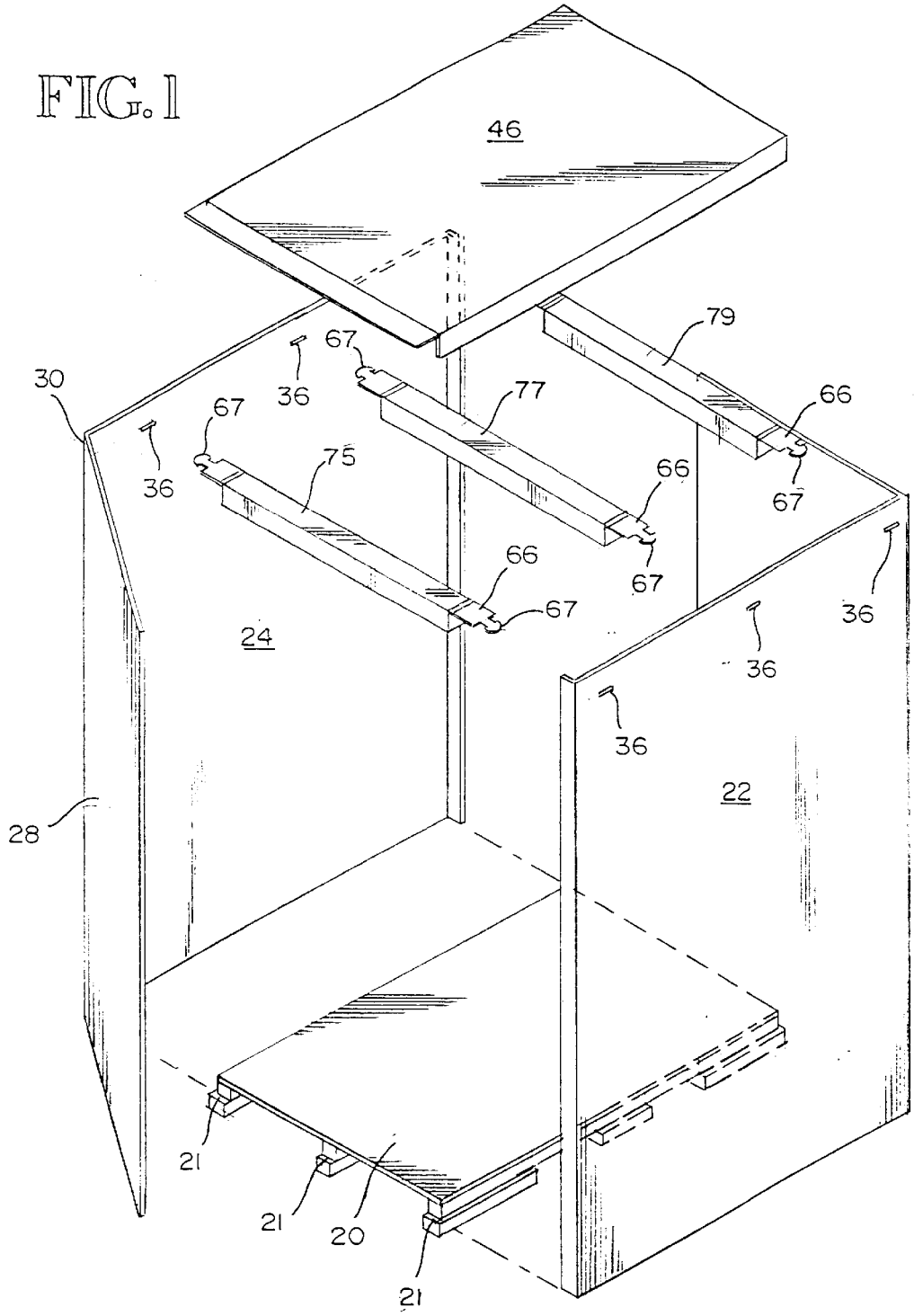
FIG. 1 is an exploded perspective view of the shipping container showing the components thereof.

Turning now to the drawings, the invention will be described in preferred embodiments by reference to the numerals of the drawing figures wherein like numbers indicate like parts.

FIG. 1 is an exploded perspective view of the shipping container showing the components thereof. The components of the embodiment depicted in FIG. 1 include a shipping pallet 20 with a top for holding the materials and goods packed in the shipping container and a bottom for resting on the surface that supports the shipping container. The pallet 20 also includes an outwardly extending lip for holding the corrugated material of the shipping container off of the supporting surface thereby not allowing moisture to degrade the corrugated material.

Also shown in FIG. 1 is the first container side panel 22 and the second container side panel 24. The container rear panel is formed from the same sheet of corrugated material as the first container side panel 22. Door 28 is formed from the same sheet of corrugated material as the second container side panel 24. Self-hinge 30 is located between the door 28 and the second container side panel 24. Side panel beam interconnection tab slots 36 are evenly spaced along the top edges of the first and second side panels 22 and 24. Interconnecting support beams 75, 77, and 79, with top panel flaps 66 and beam interconnection tabs 67 are used to support the container top panel 46.

Figure 2:
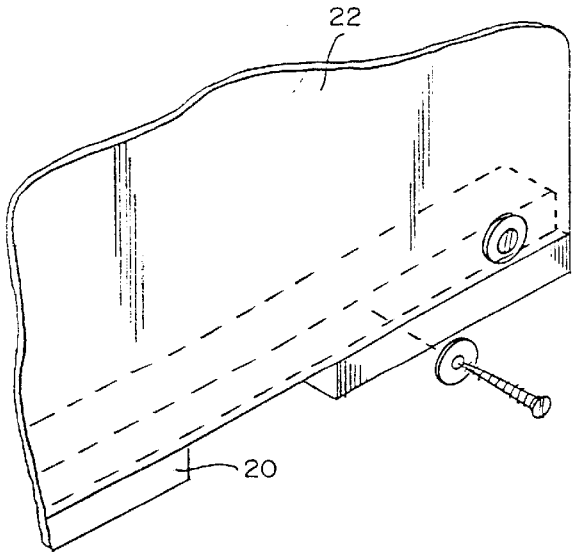
FIG. 2 is an exploded perspective view showing the sidewall of the invention being attached to the pallet.

FIG. 2 is an exploded perspective view of a method used to attach the side panels to the pallet used as a base for the shipping container. In FIG. 2, the first container side panel 22 is rested on the lip 21 (not shown) of the pallet 20. Screw type fasteners and washers are then used to attach the side panel to the pallet, however other methods that would be obvious to one skilled in the art could be used as well.

Figure 3:
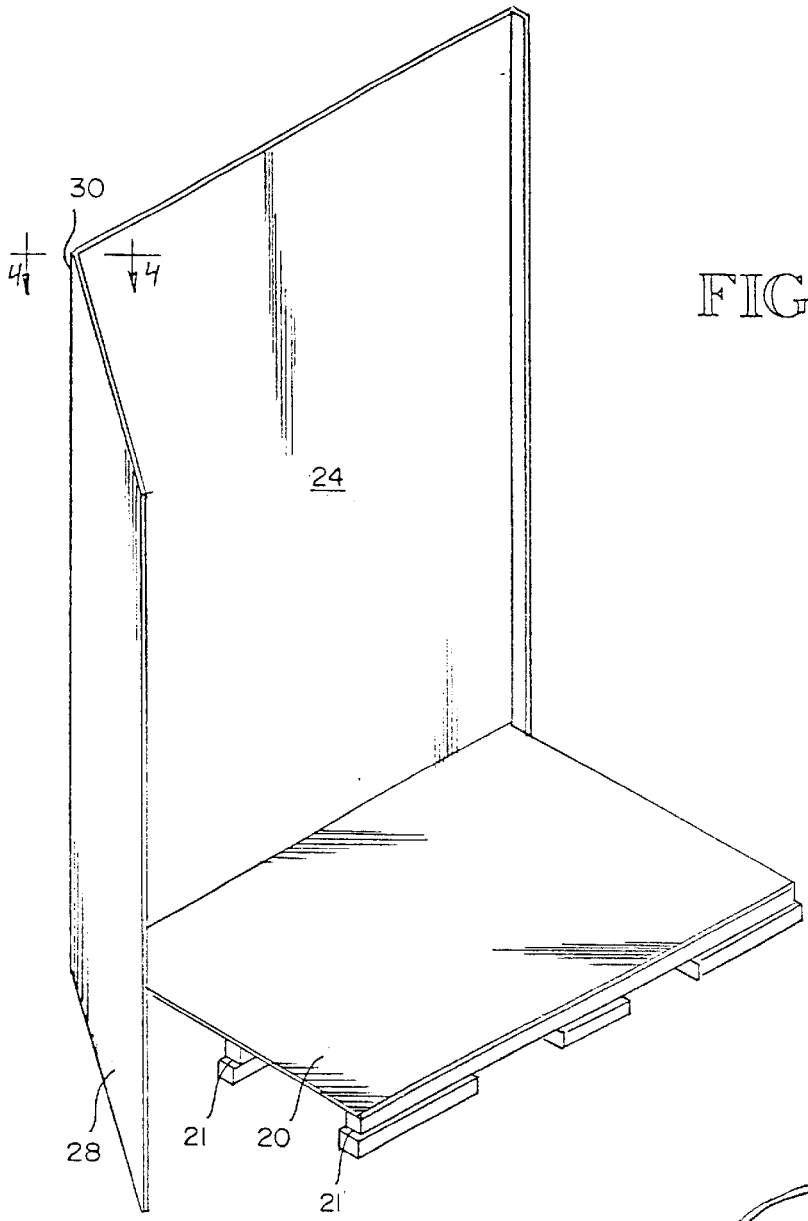
FIG. 3 is a perspective view showing the initial step of assembly with one sheet of corrugated material shown attached to the pallet and forming one side wall and a self-hinged door.
Figure 4:
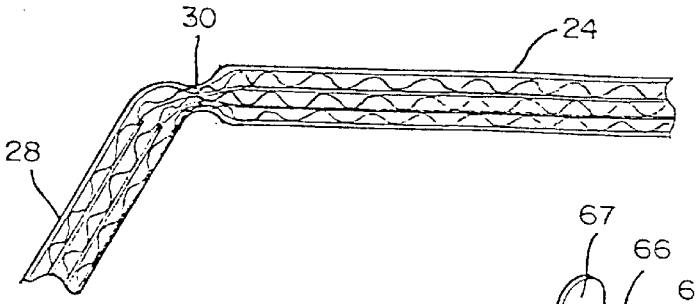
FIG. 4 is a cross sectional view taken along line 4—4 of FIG. 3 showing the self-hinge in greater detail.

FIG. 3 is a perspective view of the second container side panel 24 attached to the pallet 20. Door 28 is formed from the same sheet of corrugated material as the second container side panel 24, and is free to rotate about internal hinge 30. When door 28 is in the closed position, its bottom edge rests on the lip 21 that extends outwardly from pallet 20. FIG. 4 is a cross sectional view, taken along line 4—4 of FIG. 3, further detailing the hinge 30 between the second container side panel 24 and the door 28.

To assemble the shipping container of this invention, first and second container side panels 22 and 24 are rested on lip 21, and attached to pallet 20 in the manner depicted in FIG. 2. The container rear panel (not shown), formed from the same sheet of corrugated material that forms the first container side panel, also rests on lip 21 and is attached to pallet 20 in the manner depicted in FIG. 2. Corner uprights (not shown) that extend vertically from the top surface of the pallet 20 are then installed. The rear corner upright is positioned at the corner of the pallet 20 where the second container side panel 24 and the rear container panel (not shown) are directly adjacent to each other. The rear corner upright is then attached to the second container side panel and the container rear panel. A front corner upright is positioned at the corner of the pallet 20 diagonally opposite the rear corner upright and is attached to the first container side panel 22. The support beams 75, 77, and 79 are then assembled and interconnected to the shipping container. The container top panel 46 can then be placed on the top of the shipping container, or it can be left off to provide additional light during loading. In another embodiment (not shown), the shipping container can have a front door and a rear door to facilitate loading large or bulky objects.

Figure 5:
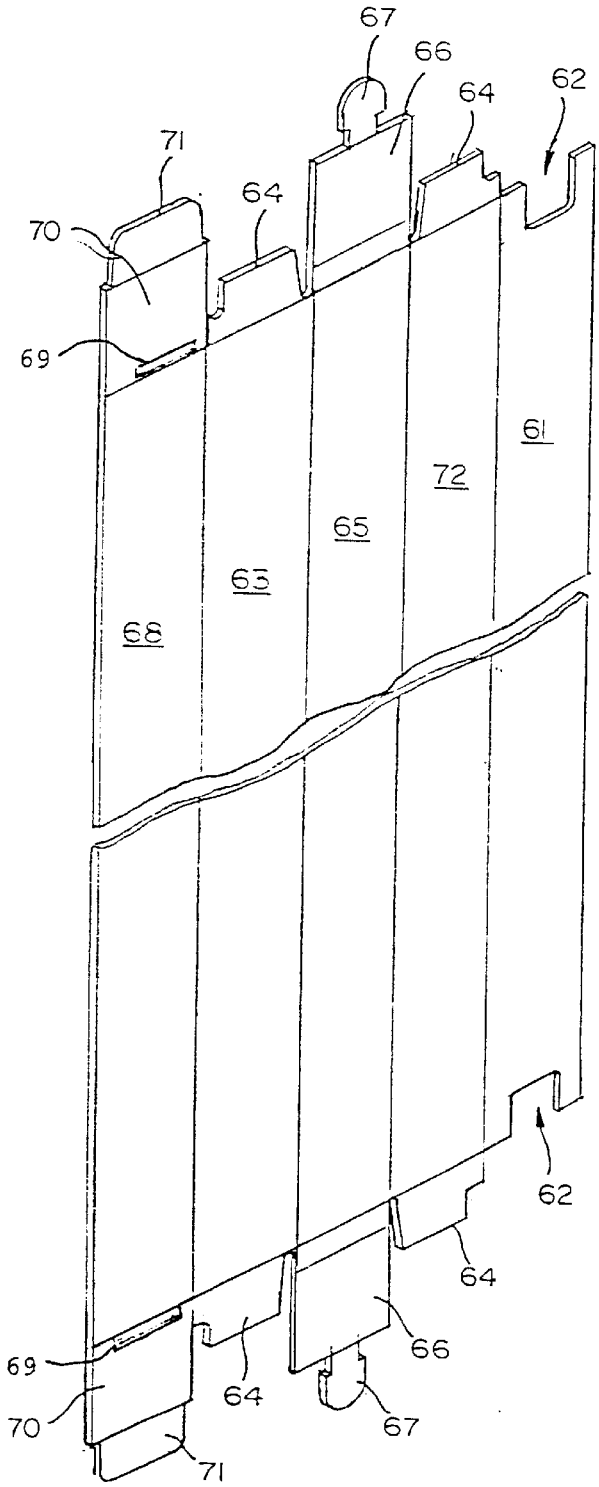
FIG. 5 is a perspective view showing the support beam of this invention in its unassembled state.

FIG. 5 is a perspective view of an interconnecting support beam of this invention in its unassembled state. The support beams are constructed using a single sheet of corrugated material with seams on the long axis of the sheet dividing it into five panels of equal width. The panels used to form the beam include a beam interior bottom panel, a first beam side panel 72, a beam top panel 65, a second beam side panel 63, and a beam exterior bottom panel 68.

The beam interior bottom panel 61 has a small rectangular notch 62 at each end and first beam side panel 72 and second beam side panel 63 each have side panel end flaps 64, defined by seams across the width of the beam side panels, at each end. Each of the side panel end flaps 64 have a small notch on the edge of the side panel end flap 64 that is opposite the beam top panel 65.

The beam top panel 65 is longer on each end than the other four panels by a length corresponding to the thickness of the first container side panel 22 and second container side panel 24 of the shipping container. The beam top panel 65 has top panel flaps 66 defined by seams at each end of the beam top panel 65. Beam interconnection tabs 67 are located at the ends of the top panel flaps 66.

The beam exterior bottom panel 68 has beam end flaps 70, defined by seams across the width of the beam exterior bottom panel 68, at each end. Beam interconnection tab slot 69 communicates through each of the beam end flaps 68. Beam end locking tabs 71, defined by a seam across the width of the beam end flaps 70, are located at the ends of the beam end flaps 70.

The support beam is assembled by folding the beam interior bottom panel 61 and the first beam side panel 72 on the seam between the first beam side panel 72 and the beam top panel 65 to make a right angle with the beam top panel. The beam exterior bottom panel 68 and the second beam side panel 63 are then folded on the seam between the second beam side panel 63 and the beam top panel 65 to make a right angle with the beam top panel 65. The beam interior bottom panel 61 is then folded toward the beam top panel 65 on the seam between the beam interior bottom panel 61 and the first beam side panel 72 to make a right angle with the first beam side panel 72. The beam exterior bottom panel 68 is then folded over the beam interior bottom panel 61 on the seam between the beam exterior bottom panel 68 and the second beam side panel 65, thereby forming a square conduit with a longitudinal channel therethrough.

The side panel end flaps 64 are then folded toward the center of the square conduit, the beam end flaps 70 are folded over the ends the longitudinal channel, and the beam end locking tabs 71 are inserted into the longitudinal channel thereby locking the beam end flaps 70 in place and completing assembly of the support beam.

Figure 6:
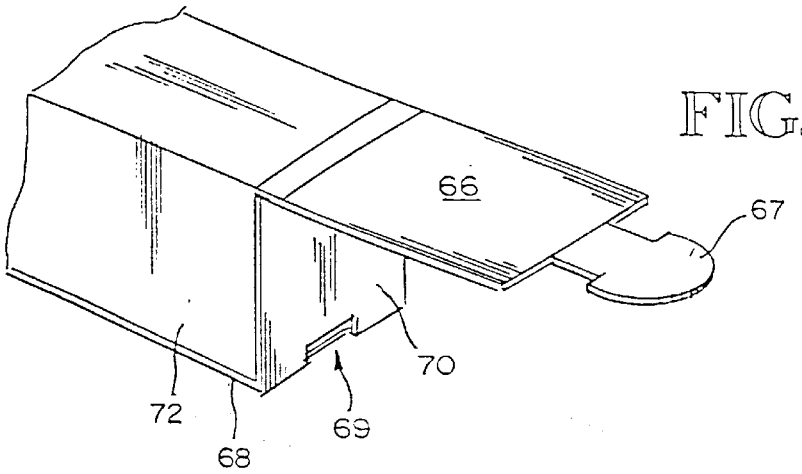
FIG. 6 is a perspective view of the end of the support beam after it has been assembled showing the beam-locking tab in greater detail.

FIG. 6 is a perspective view of one end of an assembled support beam showing the beam end flap 70 and the beam interconnection tab slot 69. Also shown in FIG. 6 are the top panel flap 66, beam interconnection tab 67, first beam side panel 72, and the beam interior bottom panel 68.

After the support beam is assembled, it is then placed in the shipping container with the beam exterior bottom panel 68 facing the top surface of the pallet and the beam top panel 65 resting on the top edges of the first container side panel 22 and the second container side panel 24. The beam end flaps 66 are folded over the first container side panel 22 and the second container side panel 24. The beam interconnection tabs 67 are routed through the side panel interconnection tab slots 36, of the first container side panel 22 and the second container side panel 24, and into the beam interconnection tab slots 69 of the beam end flaps 70.

Figure 7:
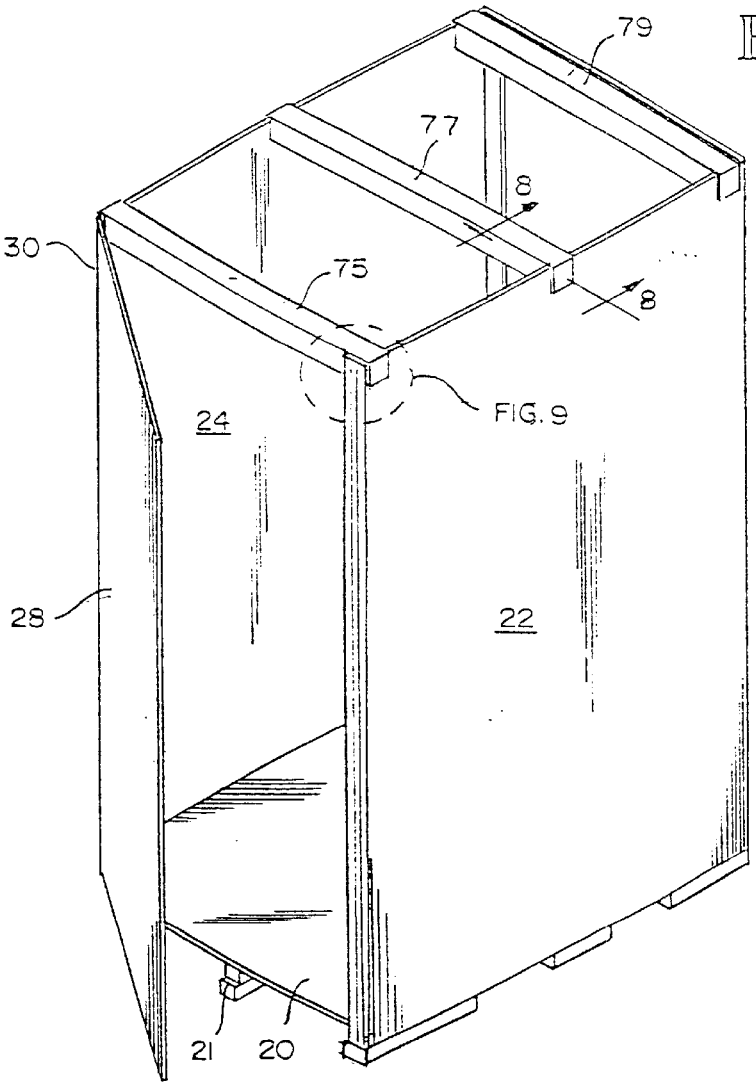
FIG. 7 is a perspective view showing the support beams attached to the shipping container of this invention.

FIG. 7 is a perspective view showing support beams 75, 77, and 79 placed in and interconnected with the shipping container of this invention. FIG. 8 is a cross sectional view taken along line 8—8 on support beam 77 of FIG. 7. FIG. 8 shows top panel flap 66 folded over the first container side panel 22. The beam interconnection tab 67 is routed through side panel interconnection tab slot 36 and into the beam interconnection tab slot 69. Although it is not shown, the notches on the edges of the side panel end flaps 64 and the notches 62 at the ends of the beam interior bottom panel 61 form a recess inside the beam, where the beam interconnection tab 67 rests after it is inserted into the beam interconnection tab slot 69.

FIG. 9 is an exploded perspective view of one corner of the shipping container of this invention showing the assembled container with the container top panel 46 held in place by packing band 52. A double-sided adhesive strip 54 is attached to the first container side panel at the corner to provide a means for holding door 28 in the closed position when access to the interior of the shipping container is not desired.

The embodiment depicted in the figures show the shipping container of this invention with one door and using triple ply corrugated material. Other embodiments can have two doors and can use corrugated material that is not triple ply. Additionally, the vertical uprights used for the embodiments described above can be made of wood or corrugated material. The shipping container of this invention is suitable for many different uses and can also serve as a temporary storage facility.

For example, a person who needs to ship or temporarily store some goods or material could have the shipping container of this invention positioned at his or her residence or place of business. The container could then be assembled in the manner described above and the goods or material could be placed inside. If the container were only to be used for storage, it would remain in place and provide temporary storage with easy access to the material or goods stored inside. If the container were to be shipped, the container would be covered with a waterproof plastic cover and packing bands would then be fastened around the outside of the container. The container would then be loaded on to a track and transported to its desired location where it could be unloaded or used for storage as described above. After the container was no longer needed, it could be disassembled for later reuse or recycling.

INDUSTRIAL APPLICABILITY

The shipping container disclosed in this invention has applicability in the field of shipping and storage of diverse goods and materials.

In compliance with the statute, the invention has been described in language more or less specific as to structural features. It is to be understood, however, that the invention is not limited to the specific features shown or described, since the means and construction shown or described comprise preferred forms of putting the invention into effect. Additionally, it will be readily apparent to those skilled in the art that the invention can be adapted to other uses, and therefore the invention should not be construed as being limited to shipping and storage of goods and materials. The invention is, therefore, claimed in any of its forms or modifications within the legitimate and valid scope of the appended claims, appropriately interpreted in accordance with the doctrine of equivalents.

What is claimed is:

1. A composite corrugated shipping container, comprising:

a base comprised of a pallet;

said pallet comprising a bottom surface, top surface, and outside edge surfaces;

said pallet further comprising an outwardly extending lip on said outside edge surfaces of said pallet, between said bottom and top surfaces of said pallet;

a first container side panel and a second container side panel;

said first and second container side panels having a bottom edge and a top edge;

said bottom edges resting on said outwardly extending lip, and said first and second container side panels attached to said pallet, and extending upwardly therefrom;

a container rear panel resting on said outwardly extending lip, attached to said pallet, and extending upwardly therefrom, said container rear panel and said first container side panel being formed from a single sheet of corrugated material;

a rear corner upright extending vertically from said top surface of said pallet;

said rear corner upright positioned at the corner of said pallet where said second container side panel and said rear container panel are directly adjacent to each other;

said rear corner upright attached to said second container side panel and said container rear panel;

a front corner upright extending vertically from said top surface of said pallet;

said front corner upright positioned at the corner of said pallet diagonally opposite said rear corner upright;

said front corner upright attached to said first container side panel;

a door and a door opening for access into said container, said door and said second container side panel being formed from a single sheet of corrugated material with a self-hinge there between;

means for releasably holding said door to said first container side panel at said front corner upright;

a container top panel, said container top panel being formed from a single sheet of corrugated material; and said container top panel having side edges bent downward for attachment to said first container side panel, said second container side panel, and said container rear panel.

2. The composite corrugated shipping container of claim 1, wherein said pallet has at least one pair of spaced apart and aligned transverse slots formed there through for cooperative engagement with the tines of a fork lift.

3. The composite corrugated shipping container of claim 1, wherein said means for releasably attaching said door comprises a hook and loop fastener.

4. The composite corrugated shipping container of claim 1, wherein said means for releasably attaching said door comprises an adhesive strip.

5. The composite corrugated shipping container of claim 1, further comprising at least one support beam, said at least one support beam extending between said first and second container side panels.

6. The composite corrugated shipping container of claim 5, wherein said support beam is made from corrugated material, and is interconnected with said first and second container side panels.

7. A composite corrugated shipping container, comprising:

a base comprised of a pallet;

said pallet comprising a bottom surface, top surface, and outside edge surfaces;

said pallet further comprising an outwardly extending lip on said outside edge surfaces of said pallet, between said bottom and top surfaces of said pallet;

said pallet having at least one pair of spaced apart and aligned transverse slots formed there through for cooperative engagement with the tines of a fork lift;

a first container side panel and a second container side panel;

said first and second container side panels having a bottom edge and a top edge;

said bottom edges resting on said outwardly extending lip, and said first and second container side panels attached to said pallet, and extending upwardly therefrom;

said first and second container side panels having a plurality of side panel beam interconnection tab slots evenly spaced along said top edges of said first and second container side panels and communicating therethrough;

a container rear panel resting on said outwardly extending lip, attached to said pallet, and extending upwardly therefrom, said container rear panel and said first container side panel being formed from a single sheet of corrugated material;

a rear corner upright extending vertically from said top surface of said pallet;

said rear corner upright positioned at the corner of said pallet where said second container side panel and said rear container panel are directly adjacent to each other;

said rear corner upright attached to said second container side panel and said container rear panel;

a front corner upright extending vertically from said top surface of said pallet;

said front corner upright positioned at the corner of said pallet diagonally opposite said rear corner upright;

said front corner upright attached to said first container side panel;

a door and a door opening for access into said container, said door and said second container side panel being formed from a single sheet of corrugated material with a self-hinge there between;

means for releasably holding said door to said first container side panel at said front corner upright;

a plurality of interconnecting support beams;

each of said support beams comprising a sheet of corrugated material with seams on the long axis of said sheet dividing said sheet into five panels of equal width;

said panels comprising a beam interior bottom panel, a first beam side panel, a beam top panel, a second beam side panel, and a beam exterior bottom panel;

said first beam side panel being adjacent to said beam interior bottom panel on one edge and said beam top panel on the edge opposite said beam interior bottom panel;

said second beam side panel being adjacent to said beam exterior bottom panel on one edge and said beam top panel on the edge opposite said beam exterior bottom panel;

said beam interior bottom panel having a small rectangular notch at each end thereof;

each of said beam side panels having a side panel end flap at each end of said beam side panels;

said side panel end flaps defined by a seam across the width of said beam side panels, at each end of said beam side panels;

each of said side panel end flaps having a notch on the edge of said side panel end flap opposite said beam top panel;

said beam top panel being longer on each end than said first and second side panels and said interior and exterior bottom panels by a length corresponding to the thickness of said first and second container side panels of said shipping container;

said beam top panel having a top panel flap at each end of said beam top panel;

said top panel flaps defined by a seam across the width of said beam top panel, at each end of said beam top panel;

each of said top panel flaps having a beam interconnection tab on the end of said top panel flaps opposite said beam top panel;

said beam exterior bottom panel having a beam end flap at each end of said beam exterior bottom panel;

said beam end flaps defined by a seam across the width of said beam exterior bottom panel, at each end of said beam exterior bottom panel;

each of said beam end flaps having a beam interconnection tab slot communicating therethrough;

each of said beam end flaps having a beam end locking tab on the end of said beam end flaps opposite said beam exterior bottom panel;

said beam end locking tabs defined by a seam across the width of said beam end flaps, on the end of said beam end flaps opposite said beam exterior bottom panel;

whereby said support beam is assembled by folding said beam interior bottom panel, said first beam side panel, said second beam side panel and said beam exterior bottom panel such that said beam exterior bottom panel covers said beam interior bottom panel, thereby forming a square conduit with a longitudinal channel there through;

said side panel end flaps are then folded toward the center of said square conduit, said beam end flaps are folded over the ends of said longitudinal channel, and said beam end locking tabs are inserted into said longitudinal channel thereby locking said beam end flaps in place and completing assembly of said support beam;

said support beam is then placed in said shipping container with said beam exterior bottom panel facing said top surface of said pallet and said beam top panel resting on said top edges of said first and second container side panels; said beam end flaps are folded over said first and second container side panels and said beam interconnection tabs are routed through said side panel interconnection tab slots of said first and second container side panels and into said beam interconnection tab slots of said beam end flaps;

a container top panel, said container top panel being formed from a single sheet of corrugated material; and said container top panel having side edges bent downward for attachment to said first container side panel, said second container side panel, and said container rear panel.

8. A composite corrugated shipping container, comprising:

a base comprised of a pallet;

said pallet comprising a bottom surface, top surface, and outside edge surfaces;

said pallet further comprising an outwardly extending lip on said outside edge surfaces of said pallet, between said bottom and top surfaces of said pallet;

said pallet having at least one pair of spaced apart and aligned transverse slots formed there through for cooperative engagement with the tines of a fork lift;

a first container side panel and a second container side panel;

said first and second container side panels having a bottom edge and a top edge;

said bottom edges resting on said outwardly extending lip, and said first and second container side panels attached to said pallet, and extending upwardly therefrom;

said first and second container side panels having a plurality of side panel beam interconnection tab slots evenly spaced along said top edges of said first and second container side panels and communicating therethrough;

a container rear panel resting on said outwardly extending lip, attached to said pallet, and extending upwardly therefrom, said container rear panel and said first container side panel being formed from a single sheet of corrugated material;

a rear corner upright extending vertically from said top surface of said pallet;

said rear corner upright positioned at the corner of said pallet where said second container side panel and said rear container panel are directly adjacent to each other;

said rear corner upright attached to said second container side panel and said container rear panel;

a front corner upright extending vertically from said top surface of said pallet;

said front corner upright positioned at the corner of said pallet diagonally opposite said rear corner upright;

said front corner upright attached to said first container side panel;

a door and a door opening for access into said container, said door and said second container side panel being formed from a single sheet of corrugated material with a self-hinge there between;

means for releasably holding said door to said first container side panel at said front corner upright;

a plurality of interconnecting support beams;

said support beams comprised of a single sheet of corrugated material;

said support beams having beam interconnection tabs and beam interconnection tab slots on each end thereof;

said support beams interconnected with said first and second container side panels;

a container top panel, said container top panel being formed from a single sheet of corrugated material; and said container top panel having side edges bent downward for attachment to said first container side panel, said second container side panel, and said container rear panel.

9. The composite corrugated shipping container of claim 8, wherein said means for releasably attaching said door comprises a hook and loop fastener.

10. The composite corrugated shipping container of claim 8, wherein said means for releasably attaching said door comprises an adhesive strip.

11. A composite corrugated shipping container, comprising:

a base comprised of a pallet;

said pallet comprising a bottom surface, top surface, and outside edge surfaces;

said pallet further comprising an outwardly extending lip on said outside edge surfaces of said pallet, between said bottom and top surfaces of said pallet;

said pallet having at least one pair of spaced apart and aligned transverse slots formed there through for cooperative engagement with the tines of a fork lift;

a first container side panel and a second container side panel;

said first and second container side panels having a bottom edge and a top edge;

said bottom edges resting on said outwardly extending lip, and said first and second container side panels attached to said pallet, and extending upwardly therefrom;

said first and second container side panels having a plurality of side panel beam interconnection tab slots evenly spaced along said top edges of said first and second container side panels and communicating therethrough;

a front door and a front door opening for access into said container, said front door and said second container side panel being formed from a single sheet of corrugated material with a self-hinge there between;

a rear door and a rear door opening for access into said container, said rear door and said first container side panel being formed from a single sheet of corrugated material with a self-hinge there between;

a rear corner upright extending vertically from said top surface of said pallet;

said rear corner upright positioned at the corner of said pallet where said second container side panel and said rear door are directly adjacent to each other when said rear door is in the closed position;

said rear corner upright attached to said second container side panel;

a front corner upright extending vertically from said top surface of said pallet;

said front corner upright positioned at the corner of said pallet diagonally opposite said rear corner upright;

said front corner upright attached to said first container side panel;

means for releasably holding said front door to said first container side panel at said front corner upright;

means for releasably holding said rear door to said second container side panel at said rear corner upright;

a plurality of interconnecting support beams;

said support beams comprised of a single sheet of corrugated material;

said support beams having beam interconnection tabs and beam interconnection tab slots on each end thereof;

said support beams interconnected with said first and second container side panels;

a container top panel, said container top panel being formed from a single sheet of corrugated material; and said container top panel having side edges bent downward for attachment to said first container side panel, said second container side panel.

12. The composite corrugated shipping container of claim 11, wherein said means for releasably attaching said front and rear doors comprises a hook and loop fastener.

13. The composite corrugated shipping container of claim 11, wherein said means for releasably attaching said front and rear doors comprises an adhesive strip.

14. An interconnecting support beam for a shipping container comprising;

a sheet of corrugated material with seams on the long axis of said sheet dividing said sheet into five panels of equal width;

said panels comprising a beam interior bottom panel, a first beam side panel, a beam top panel, a second beam side panel, and a beam exterior bottom panel;

said first beam side panel being adjacent to said beam interior bottom panel on one edge and said beam top panel on the edge opposite said beam interior bottom panel;

said second beam side panel being adjacent to said beam exterior bottom panel on one edge and said beam top panel on the edge opposite said beam exterior bottom panel;

said beam interior bottom panel having a small rectangular notch at each end thereof;

each of said beam side panels having a side panel end flap at each end of said beam side panels;

said side panel end flaps defined by a seam across the width of said beam side panels, at each end of said beam side panels;

each of said side panel end flaps having a notch on the edge of said side panel end flap opposite said beam top panel;

said beam top panel being longer on each end than said first and second side panels and said interior and exterior bottom panels by a length corresponding to the thickness of the walls of the shipping container said beam will be used with;

said beam top panel having a top panel flap at each end of said beam top panel;

said top panel flaps defined by a seam across the width of said beam top panel, at each end of said beam top panel;

each of said top panel flaps having a beam interconnection tab on the end of said top panel flaps opposite said beam top panel;

said beam exterior bottom panel having a beam end flap at each end of said beam exterior bottom panel;

said beam end flaps defined by a seam across the width of said beam exterior bottom panel, at each end of said beam exterior bottom panel;

each of said beam end flaps having a beam end locking tab on the end of said beam end flaps opposite said beam exterior bottom panel;

said beam end locking tabs defined by a seam across the width of said beam end flaps, on the end of said beam end flaps opposite said beam exterior bottom panel;

whereby said support beam is assembled by folding said beam interior bottom panel, said first beam side panel, said second beam side panel and said beam exterior bottom panel such that said beam exterior bottom panel covers said beam interior bottom panel, thereby forming a square conduit with a longitudinal channel there through;

said side panel end flaps are then folded toward the center of said square conduit, said beam end flaps are folded over the ends of said longitudinal channel, and said beam end locking tabs are inserted into said longitudinal channel thereby locking said beam end flaps in place and completing assembly of said support beam.

* * * * *